US006918615B2

(12) United States Patent
Petkovsek

(10) Patent No.: US 6,918,615 B2
(45) **Date of Patent: *Jul. 19, 2005**

(54) SPECIAL SERVICE MAILING LABEL CAPABLE OF RECEIVING ELECTRONICALLY IMAGED POSTAGE AND A METHOD FOR USING SAME

(76) Inventor: Glenn Petkovsek, 521 E. Markham St., Little Rock, AR (US) 72201

( * ) Notice: Subject to any disclaimer, the term of this patent is extended or adjusted under 35 U.S.C. 154(b) by 22 days.

This patent is subject to a terminal disclaimer.

(21) Appl. No.: 09/852,184

(22) Filed: May 9, 2001

(65) Prior Publication Data

US 2002/0167162 A1 Nov. 14, 2002

(51) Int. Cl.[7] ..... B42D 15/00

(52) U.S. Cl. ..... 283/71; 283/79; 283/81; 283/101; 283/103; 705/14

(58) Field of Search ..... 283/71, 79, 81, 283/101, 103; 705/14

(56) References Cited

U.S. PATENT DOCUMENTS

| | | | | | |
|---|---|---|---|---|---|
| 5,573,277 | A | * | 11/1996 | Petkovsek | 283/101 |
| 5,782,494 | A | * | 7/1998 | Crandall et al. | 281/12 |
| 6,089,613 | A | * | 7/2000 | Petkovsek | 229/300 |
| 6,241,844 | B1 | * | 6/2001 | Petkovsek | 156/249 |
| 6,305,716 | B1 | * | 10/2001 | Warther et al. | 283/61 |
| 6,371,521 | B1 | * | 4/2002 | Petkovsek | 283/116 |
| 2002/0103697 | A1 | * | 8/2002 | Lockhart et al. | 705/14 |
| 2003/0015867 | A1 | * | 1/2003 | Petkovsek | 283/81 |

* cited by examiner

*Primary Examiner*—Derris H. Banks
*Assistant Examiner*—Mark T. Henderson

(57) ABSTRACT

A form is provided for printing mailpiece information relating to mail handling for attachment to a mailpiece as well as a method for preparing a mailpiece for delivery by a special service. The form may have sections that may be removably secured to a backer and may be capable of receiving printed information regarding a sender, recipient, or mailing service. In addition, the form may receive various types of electronic postage accessed via the internet, for example. After mailing information is printed on the form, the section may be removed and secured to a mailpiece.

7 Claims, 2 Drawing Sheets

SPECIAL SERVICE MAILING LABEL CAPABLE OF RECEIVING ELECTRONICALLY IMAGED POSTAGE AND A METHOD FOR USING SAME

BACKGROUND OF THE INVENTION

The present invention generally relates to a form for printing mailpiece information relating to mail handling for attachment to a mailpiece as well as a method for preparing a mailpiece for delivery by a special service, such as registered mail, certified mail, insured mail, or the like. More specifically, the present invention relates to a form which may have a plurality of detachable parts capable of having mailing information printed thereon by a printer or the like. The form may have two sheets: a first sheet having a plurality of detachable parts and a second sheet to which the first sheet may be adhesively attached. Electronically-imaged postage, accessed through the internet, may be printed on the form.

It is, of course, generally known to provide specialized postal processing for a mailpiece. A mailpiece may require delivery by one or more of a variety of special services, such as certified mail, registered mail, insured mail, or the like. Preparation may involve the printing of mailing information onto, for example, a label. The printing of information may be done manually or by, for example, a printer or the like.

To this end, forms are known which allow a printer to print mailing information onto a plurality of adhesive labels contained within the form. The labels may then be affixed to a mailpiece. However, known forms may contain non-uniform layers, having both adhesive and non-adhesive portions, which may make the form expensive to manufacture.

Of course, a mailpiece requires postage to be affixed thereto for delivery. Special service delivery of a mailpiece also requires additional postage to effect delivery. It is also generally known to provide postage for a mailpiece. The postage may be provided by a postage meter or other device. The postage may be generally attached to a mailpiece separate from the attachment of mailing information. Preparation of a mailpiece for delivery then becomes tedious and/or time-consuming.

Postage may also be provided by access to the internet. A user may download the postage from an internet postage supplier. The postage may then be stored within a central processing unit. The postage may be electronically transmitted to a printer and printed. However, known postage systems provide postage on forms separate from those forms receiving mailing information such as sender and recipient information or the like. Further, known postage provided on the internet takes various forms and configurations which requires different forms to be used or a separate form for the postage than what is used for the special service mailing form.

A need, therefore, exists for a mailing label and method for preparing a mailpiece for delivery by a special service that provides a label capable of having both mailing information and postage printed simultaneously and using the same form.

SUMMARY OF THE INVENTION

The present invention provides a mailing form and a method for preparing a mailpiece for delivery by a special service. The form is configured to allow printing of mailing information and postage information simultaneously.

In an embodiment, a form for delivery of a mailpiece by a special service is provided having a first layer with a front side and a back side wherein the front side of the first layer has a plurality of parts and further wherein the plurality of parts receives one of a plurality of types of electronically-imaged postage accessed over a global computer network. The postage is necessary to effect the delivery of the mailpiece by the special service.

In an embodiment, a second layer is provided having a front side with a non-adhesive layer wherein each of the plurality of parts is removably secured to the non-adhesive layer.

In an embodiment, one of the plurality of parts receives special service mail information.

In an embodiment, the form has a postcard subsection.

In an embodiment, the form provides a special mailing service section that receives special mailing service information.

In an embodiment, one of the plurality of parts receives sender information.

In an embodiment, one of the plurality of parts of the form receives recipient information.

In an embodiment of the present invention, a method is provided for assembling a mailpiece requiring delivery by a special service. The method comprises the steps of: providing a form having a first layer having a front side and a back side wherein the front side of the first layer has a plurality of parts and further wherein the plurality of parts receives one of a plurality of types of electronically-imaged postage accessed over a global computer network wherein the postage necessary to effect the delivery of the mailpiece by the special service; and providing for printing electronically-imaged postage accessed over a global computer network onto the form.

In an embodiment, the method provides for removing one of the plurality of parts from the form.

In an embodiment, the method provides for attaching one of the plurality of parts to the mailpiece.

In an embodiment, the method provides for printing special service mailing information on one of the plurality of parts.

In an embodiment, printing sender information on one of the plurality of parts is provided.

In an embodiment, a method is provided for imprinting a machine-readable code on one of the plurality of parts.

It is, therefore, an advantage of the present invention to provide a mailing form and a method for preparing a mailpiece to allow greater convenience in manufacturing a mailpiece by incorporating a uniform adhesive layer.

Another advantage of the present invention is to provide a mailing form and a method for preparing a mailpiece for delivery to provide less expensive manufacture of a mailing form.

Yet another advantage of the present invention is to provide a mailing form and a method of preparing a mailpiece capable of receiving postage to reduce the amount of time spent in preparing a mailpiece.

Another advantage of the present invention is to provide a mailing form capable of receiving postage and a method of preparing a mailpiece to allow more than one type of postage to be printed on the mailing form.

Still another advantage of the present invention is to provide a mailing form capable of receiving postage and a method of preparing a mailpiece allowing less labor to be expended in preparation of a mailpiece.

Another advantage of the present invention is to provide a mailing form capable of receiving postage and a method of preparing a mailpiece to provide less expensive preparation of a mailpiece.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a mailing form and a method for preparing a mailpiece for delivery by a special service. The form is configured to allow printing of mailing information and postage information simultaneously wherein the postage information may be a plurality of types of known electronic postage.

Figure 1:
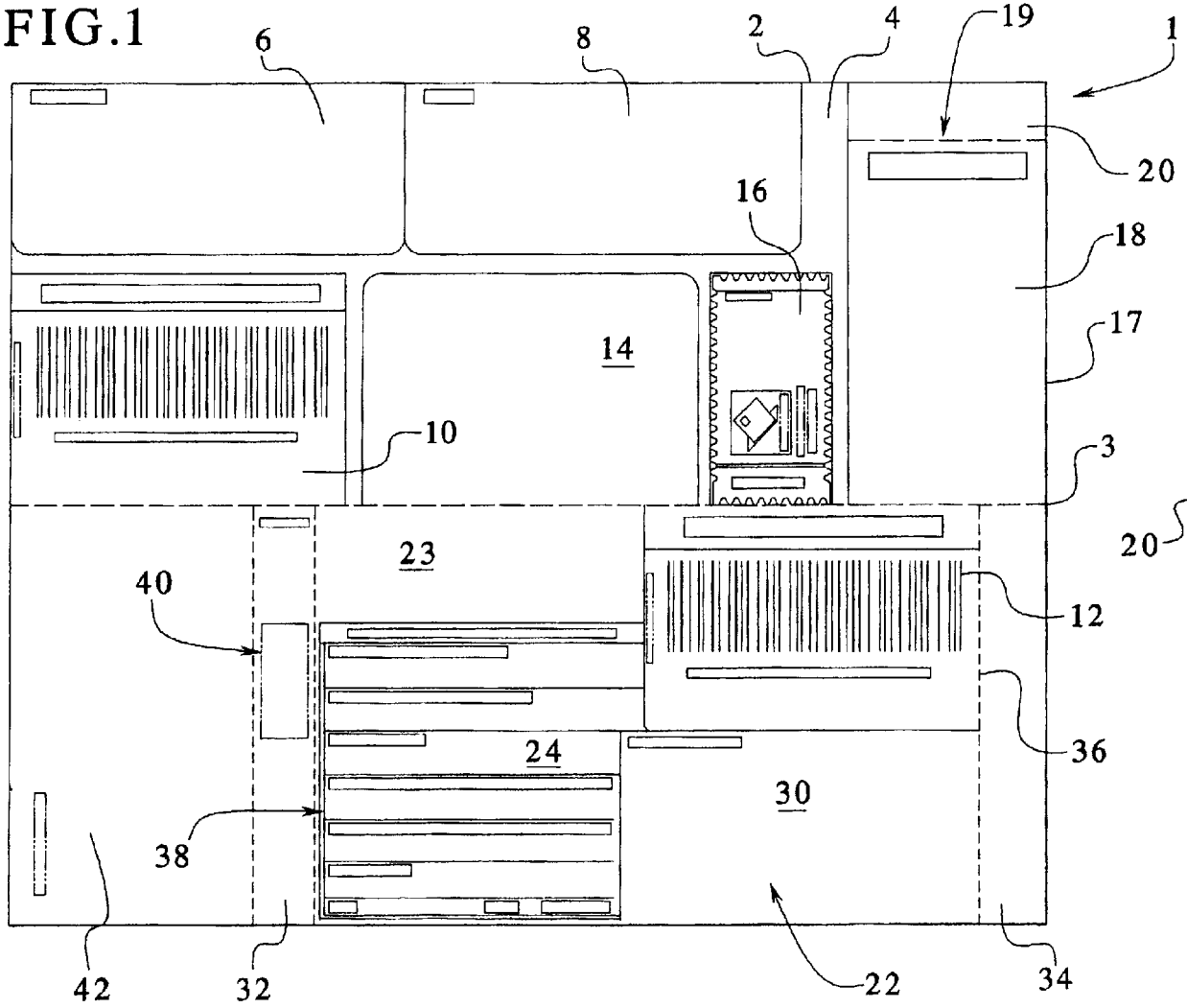
FIG. 1 illustrates a cross-sectional view of an embodiment of a mailing form of the present invention.

Referring now to the drawings wherein like numerals refer to like parts, FIG. 1 is a cross-sectional view that generally illustrates an embodiment of a form 1 which may have two layers. A top layer 110 may have a front side 2 and a back side 120. The back side 120 of the top layer 110 may have an adhesive layer 130. The adhesive layer 130 may be uniform along the back side 120 of the form 1. The form 1 may have a bottom layer 140 having a back side 150 and a top side 160. Adjacent to the top side 160 of the bottom layer 150 may be a layer 170 of non-adhesive material.

Figure 2:
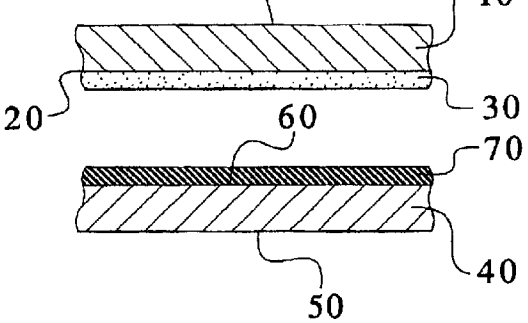
FIG. 2 illustrates a plan view of a front side of an embodiment of a mailing form of the present invention.

FIG. 2 illustrates a plan view of the form 1. The top layer 110 may be divided into a plurality of detachable parts. Between each of the detachable parts on the front side 2 may be a divider 4 which may border one or more of the detachable parts. Each of the detachable parts may have an area in which information may be printed by the user and/or a printer or the like. Each of the detachable parts may be attached to the form 1 by the adhesive layer 130.

In a preferred embodiment, the form 1 has a recipient information subsection 6 which may contain recipient information such as, for example, a delivery address for a recipient of the mailpiece. A sender information subsection 8 may also be provided which may contain sender information such as, for example, a return address.

In addition, a sender record subsection 20 may be provided in a corner 21 of the form 1. The sender record subsection 20 may, for example, display a certified mail serial number. The sender record subsection 20 may be separated from a postal service receipt subsection 18 by a perforation 19. The postal service subsection 18 may contain, for example, a receipt for registered mail. The postal service subsection 18 may also include, for example, a postmark, a date of mailing, or the like.

The present invention may also provide a registered mail tracking subsection 10 which may contain registered mail tracking information including, for example, a bar code, serial number, or the like. The registered mail tracking subsection 10 may also have, for example, mailing service instructions such as, for example, "Return Receipt Requested." The registered mail tracking subsection 10 may then be separated from the form 1 and affixed to a postcard subsection 22 if the mailpiece is sent by registered mail.

In addition, the present invention may provide a first stamp subsection 14 or a second stamp subsection 16. The first stamp subsection 14 or the second stamp subsection 16 may contain, for example, electronically imaged postage which may be imaged by a printer or the like.

Figure 3:
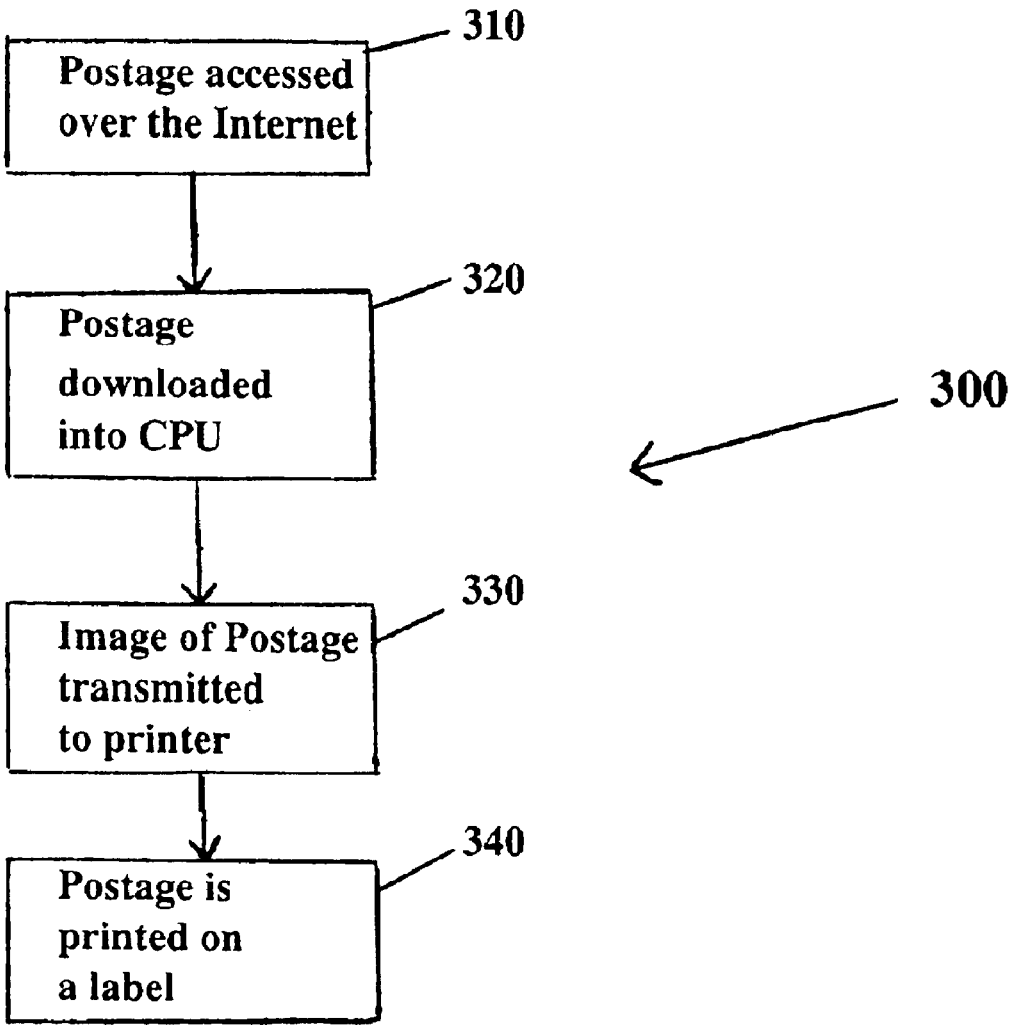
FIG. 3 illustrates a box diagram of a process in an embodiment of a method of the present invention.

FIG. 3 illustrates a process 300 by which the postage may be printed onto the form 1. The postage may be accessed as shown at step 310 over the internet. The postage may then be downloaded as shown at step 320 into a central processing unit or the like. An image of the postage may then be transmitted 330 to a printer for printing as shown at step 340 onto the label. The particular subsection on the form 1 which receives the electronic postage may be determined by the particular internet postage provider accessed by a user. A user may have a particular account with an internet provider, and the postage may be paid for upon downloading as shown at step 320 of the postage. The first stamp subsection 14 or the second stamp subsection 16 may then be removed after printing of the postage and affixed to a mailpiece.

The first stamp subsection 14 and the second stamp subsection 16 may be sized to receive only certain types of postage from a particular internet postage provider. A user may be able to use the form 1 if the internet postage provider with which the user has an account provides electronic postage sized to fit within the first stamp subsection 14 or the second stamp subsection 16. OF course, the form 1 may be adapted to fit other sizes of electronic postage and/or additional sizes of electronic postage.

A return address subsection 42 may also be provided on which return address information of the sender may be printed. The return address subsection 42 may then be detached and may be retained, for example, by the sender for record-keeping purposes.

A postcard subsection 22 may also be provided which may be returned to a sender upon receipt by an addressee. The postcard subsection 22 may have a return address section 23 on which a return address may be printed. The postcard subsection 22 may also have a post-delivery subsection 24 on which information, such as, for example, the date of delivery, a name of an individual who may be receiving the mailpiece at the time of delivery, a recipient address if different from the address used by the sender, or the like, may be printed or written after the mailpiece is received by an addressee. In addition, the postcard subsection 22 may have an addressee section 30 on which addressee information may be printed. The postcard subsection 22 may further have a certified mail tracking subsection 36 which may have, for example, certified mail tracking information, such as, for example, a bar code or other machine readable code, a serial number, or the like.

A receiver record subsection 32 may be provided on one side of the length of the postcard subsection 22. A perforation 38 may allow the receiver record subsection 32 to be detached from the postcard subsection 22. The receiver record subsection 32 may have information printed concerning the type of mailing service chosen, such as, for example, certified mail, and may also include, for example, a serial number, or the like. A blank subsection 34 may also be adjacent to the postcard subsection 22 opposite the receiver record subsection 32. A perforation 37 may exist where the blank subsection 34 may be in contact with the postcard subsection 22. The blank subsection 34 may also border a perforation 3.

A user may detach the receiver record subsection 32 along the perforation 40. The user may then detach the postcard subsection 22 along the perforation 3 and detach the blank subsection 34 along the perforation 3 to affix the receiver record subsection 32, the postcard subsection 22 and the blank subsection 34 onto a mailpiece. The non-adhesive backing 140 may be removed from the receiver record subsection 32 or the blank subsection 34. After the mailpiece is delivered to the recipient, the postcard subsection 22 may be detached from the blank subsection 34 and the receiver record subsection 32 and may be returned to the sender.

Although, in the preferred embodiment, each section or subsection may be designated with a specific function, the sections or subsections should not be construed as limited solely to those functions. In fact, each subsection may be used interchangeably to contain sender, addressee or mailing service information.

In another embodiment, the form 1 may be part of a continuous roll, sheet, or the like. The roll may be fed into, for example, a printer. Moreover, the form 1 may be attached, for example, along an edge of the form 1 to an identical form 1 by, for example, a perforation. After information is printed on the form 1, the form 1 may be detached from the roll at the perforation, and the detachable parts having printed information may be removed and affixed to a mailpiece.

After postage is printed on the first stamp subsection 14 or the second stamp subsection 16 and other mailing information has been printed onto the respective subsection for the mailing information, the mailpiece may be prepared for delivery. To this end, the subsections having printed information may be removed from the form 1 and affixed to the mailpiece. If the mailpiece is sent by registered mail, the registered mail tracking subsection 10 may be removed from the form 1 and placed over the certified mail tracking subsection 36 in the postcard subsection 22. In addition, the postcard subsection 22 may be removed and affixed to the mailpiece. After the mailpiece has been delivered, the postcard subsection 22 may be detached from the mailpiece and may then be sent to the return address.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A form for delivery of a mailpiece by a special service, the form comprising:

a first layer having a front aide and a back side wherein the front side of the first layer has a plurality of parts and further wherein a first part receives a first type of electronically-imaged postage accessed over a global computer network wherein a second part receives a second type of electronically-imaged postage accessed over a global computer network wherein the first type of electronically-imaged postage is accessible from a first provider of electronically-imaged postage and the second type of electronically-imaged postage is accessible from a second provider of electronically-imaged postage and further wherein one of the first type of electronically-imaged postage or the second type of electronically-imaged postage is necessary to effect the delivery of the mailpiece by the special service wherein one of the first part or the second part is removable from the front side of the first layer and attaches to the mailpiece to effect the delivery of the mailpiece by the special service.

2. The form of claim 1 further comprising:

a second layer having a front side with a non-adhesive layer wherein each of the plurality of parts is removably secured to the non-adhesive layer.

3. The form of claim 1 wherein one of the plurality of parts receives special service mail information.

4. The form of claim 1 further having:

a postcard subsection.

5. The form of claim 1 further comprising a special mailing service section that receives special mailing service information.

6. The form of claim 1 wherein one of the plurality of parts receives sender information.

7. The form of claim 1 wherein one of the plurality of parts receives recipient information.

* * * * *